US008265937B2

(12) United States Patent
Griffin et al.

(10) Patent No.: US 8,265,937 B2
(45) Date of Patent: Sep. 11, 2012

(54) BREATHING APPARATUS SPEECH ENHANCEMENT USING REFERENCE SENSOR

(75) Inventors: Daniel W. Griffin, Hollis, NH (US); John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 1107 days.

(21) Appl. No.: 12/021,789

(22) Filed: Jan. 29, 2008

(65) Prior Publication Data

US 2009/0192799 A1 Jul. 30, 2009

(51) Int. Cl.
*G10L 21/02* (2006.01)

(52) U.S. Cl. ..... 704/274; 704/226; 704/270

(58) Field of Classification Search ..... None
See application file for complete search history.

(56) References Cited

U.S. PATENT DOCUMENTS 4,358,737 A * 11/1982 Bennett ..... 327/45
4,484,354 A * 11/1984 Bennett et al. ..... 455/701
5,225,769 A * 7/1993 Fincke et al. ..... 324/127
5,275,158 A * 1/1994 Lopin ..... 607/6
6,058,194 A * 5/2000 Gulli et al. ..... 381/94.8
6,816,741 B2 * 11/2004 Diab ..... 600/324
6,894,488 B2 * 5/2005 Kikugawa et al. ..... 324/210
7,026,810 B2 * 4/2006 Kikugawa et al. ..... 324/210
7,123,176 B1 * 10/2006 Jordanov ..... 341/132
7,139,701 B2 * 11/2006 Harton et al. ..... 704/217
7,155,388 B2 * 12/2006 Kushner et al. ..... 704/233
7,254,535 B2 * 8/2007 Kushner et al. ..... 704/226
7,617,099 B2 * 11/2009 Yang et al. ..... 704/228
7,693,712 B2 * 4/2010 Gaeta et al. ..... 704/226
7,809,559 B2 * 10/2010 Kushner et al. ..... 704/228
2010/0108065 A1 * 5/2010 Zimmerman et al. ... 128/204.23

* cited by examiner

*Primary Examiner* — Tālivaldis I Vars Šmits
(74) *Attorney, Agent, or Firm* — Fish & Richardson P.C.

(57) ABSTRACT

Speech enhancement in a breathing apparatus is provided using a primary sensor mounted near a breathing mask user's mouth, at least one reference sensor mounted near a noise source, and a processor that combines the signals from these sensors to produce an output signal with an enhanced speech component. The reference sensor signal may be filtered and the result may be subtracted from the primary sensor signal to produce the output signal with an enhanced speech component. A method for detecting the exclusive presence of a low air alarm noise may be used to determine when to update the filter. A triple filter adaptive noise cancellation method may provide improved performance through reduction of filter maladaptation. The speech enhancement techniques may be employed as part of a communication system or a speech recognition system.

17 Claims, 7 Drawing Sheets

BREATHING APPARATUS SPEECH ENHANCEMENT USING REFERENCE SENSOR

BACKGROUND

This document relates to speech enhancement in a breathing apparatus.

There are numerous situations which require the use of a breathing apparatus such as the absence of a breathable atmosphere or the potential for this condition. An exemplary breathing apparatus consists of a face mask with a regulator that supplies air from a high pressure hose on demand from the user. The high pressure hose is usually connected to an air tank. When the pressure in the air tank falls below a set level, a low air alarm is generated to warn the user. A common low air alarm is generated by a valve in the regulator which releases pulses of air which can easily be sensed by the user. These pulses of air can produce pressure levels inside the mask which exceed the user's voice pressure levels. These high levels of pressure can act as interfering noise that can make tasks such as communication or automatic speech recognition more difficult.

A second source of interfering noise results from the turbulence of the air or gas released into the breathing mask by the regulator during inhalation. Inhalation noise may be reduced by turning a microphone off when the pressure drops.

Inhalation noise may be detected and attenuated by measuring the frequency response of a breathing mask to determine resonances and antiresonances, and by acting on this information.

SUMMARY

In one aspect, generally, a breathing apparatus speech enhancement system includes a breathing mask, a primary sensor which produces a primary signal, and at least one reference sensor which produces a reference signal. A processor combines the sensor signals to produce an output signal with an enhanced speech component.

Implementations may include one or more of the following features. For example, each of the primary sensor and the reference sensor may be a microphone, such as a microphone of the noise canceling or gradient type.

The primary sensor may be mounted on the breathing mask so as to be near the mouth of a user wearing the breathing mask. When the breathing mask includes a voice port, the primary sensor may be mounted externally to the mask near the voice port.

A reference sensor may be mounted near a noise source, such as the user's mouth. The breathing mask may include a breath screen to shield at least one reference sensor to reduce the impact of air flow from the user's mouth.

The system may include a wireless transmitter connected to transmit the primary signal and/or the reference signal wirelessly.

The system may be incorporated in a communication system and may further include a speech recognition system configured to process the output signal with the enhanced speech component The processor may employ a filter to filter the reference signal, and may subtract the filtered reference signal from the primary signal to produce the output signal. The processor may update the filter based on the output signal and the reference signal. The processor may do so in a transform domain to improve a convergence rate of the filter.

The system may employ techniques for detecting the exclusive presence of an alarm signal. For example, the processor may detect the exclusive presence of an alarm signal by receiving the primary signal, determining the energy of the primary signal, determining a peak count of the number of consecutive energy samples below a first threshold, and determining a valley count of the number of consecutive energy samples above a second threshold. The processor then determines an alarm count of the number of consecutive samples for which the peak count and valley count are below a third threshold, and declares the exclusive presence of the alarm signal when the alarm count exceeds a fourth threshold. The processor may be configured to only update the filter upon detecting the exclusive presence of an alarm signal.

More general systems and techniques for detecting the exclusive presence of an alarm signal may be provided. For example, a method for such detection may include receiving a digitized audio signal, determining the energy of the digitized audio signal, determining a peak count of the number of consecutive energy samples below a first threshold, determining a valley count of the number of consecutive energy samples above a second threshold, determining an alarm count of the number of consecutive samples for which the peak count and valley count are below a third threshold, and declaring the exclusive presence of the alarm signal when the alarm count exceeds a fourth threshold. A system for such detection may include a processor configured to perform the method described above.

The system also may employ triple filter noise cancellation techniques to achieve improved noise cancellation performance through reduction of filter maladaptation. For example, the processor may filter the reference signal with an output filter to produce an output filtered reference signal and subtract the output filtered reference signal from the primary signal to produce an output signal. The processor also may filter the reference signal with an evaluation filter to produce an evaluation filtered reference signal, and subtract the evaluation filtered reference signal from the primary signal to produce an evaluation signal. Finally, the processor may filter the reference signal with an update filter to produce an update filtered reference signal, subtract the update filtered reference signal from the primary signal to produce an update signal, modify the update filter based on the reference signal and the update signal, modify the evaluation filter based on the update filter, and modify the output filter based on the output signal and the evaluation signal.

More general systems and techniques for triple filter noise cancellation may be provided. For example, a method for such noise cancellation may include receiving a digitized primary audio signal, receiving at least one digitized reference audio signal, filtering the at least one reference signal with an output filter to produce an output filtered reference signal, subtracting the output filtered reference signal from the primary signal to produce an output signal, filtering the at least one reference signal with an evaluation filter to produce an evaluation filtered reference signal, subtracting the evaluation filtered reference signal from the primary signal to produce an evaluation signal, filtering the at least one reference signal with an update filter to produce an update filtered reference signal, subtracting the update filtered reference signal from the primary signal to produce an update signal, modifying the update filter based on the reference signal and the update signal, modifying the evaluation filter based on the update filter, and modifying the output filter based on the output signal and the evaluation signal.

The update filter may be modified only when the exclusive presence of a noise signal is declared, such as by using the techniques above.

The details of one or more implementations are set forth in the accompanying drawings and the description below. Other features will be apparent from the description and drawings, and from the claims.

DETAILED DESCRIPTION

Figure 1:
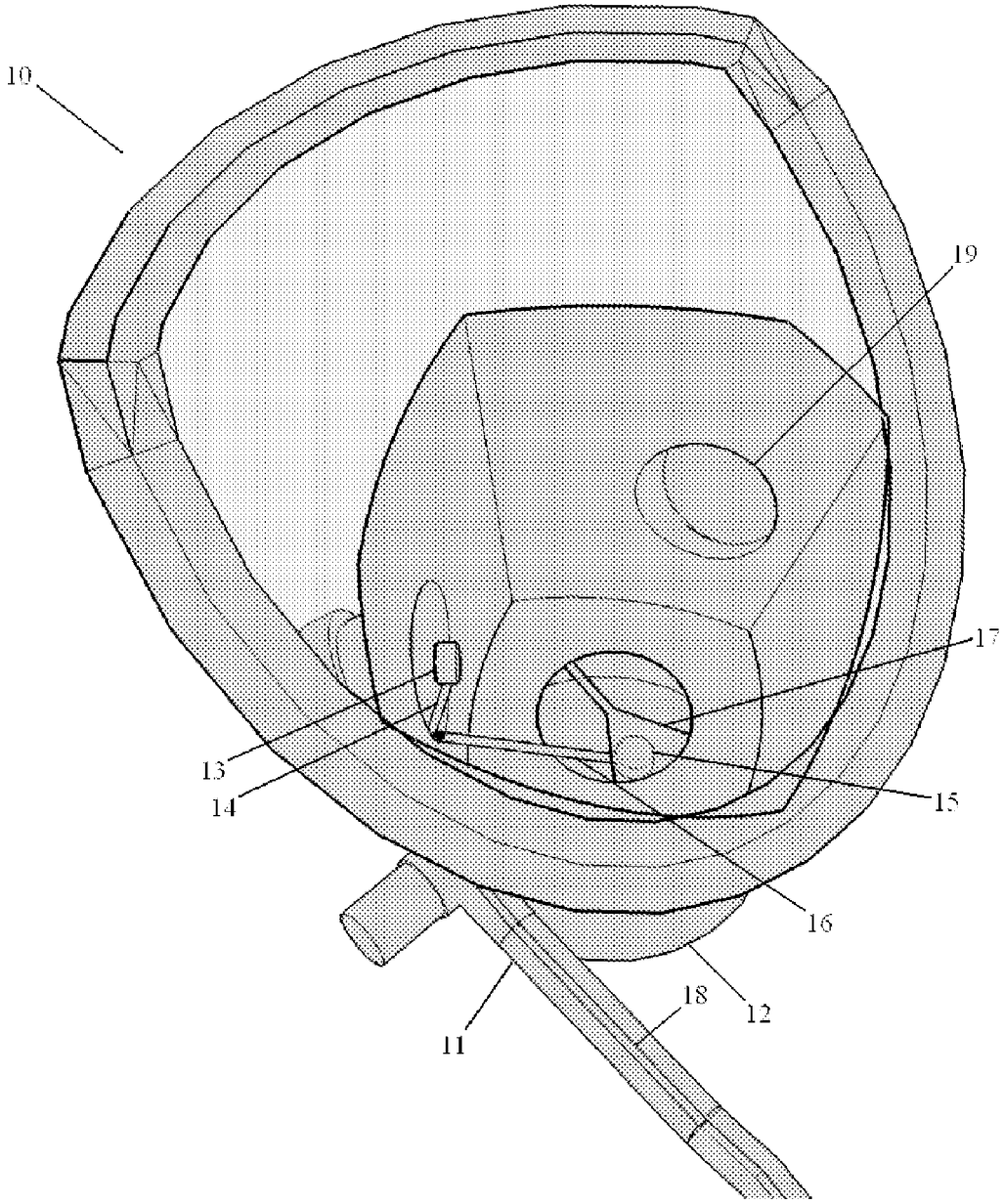
FIG. 1 is a perspective drawing of a breathing mask.

FIG. 1 shows a breathing mask 10 with a hose 11 which delivers pressurized breathing gas through a demand regulator 12. A primary sensor 13 is held in position by support 14 which also serves to contain signal wires for the primary sensor. A reference sensor 15 is held in position by support 16 which also serves to contain signal wires for the reference sensor. Breath screen 17 shields the reference sensor from the flow of air emanating from the wearer's mouth. Cable 18 contains signal wires for the primary and reference sensors which may be connected to the signal acquisition system 20 shown in FIG. 2. Voice port 19 provides a passive means for acoustic signals to travel from the interior of the mask to the exterior while maintaining a barrier to the flow of gases.

In some applications, such as retrofitting an existing breathing mask with sensors, it may be desirable to avoid penetration of the mask by cable 18. One method of achieving this objective is to connect the sensors to a wireless transmitter mounted interior to the mask. The primary and reference signals are then transmitted to a wireless receiver external to the mask which is connected to a processor.

Another method of avoiding mask penetration is to mount the sensors external to the mask. An exemplary location for the primary sensor 13 is near the external portion of voice port 19. An exemplary location for the reference sensor 15 is near demand regulator 12.

Figure 2:
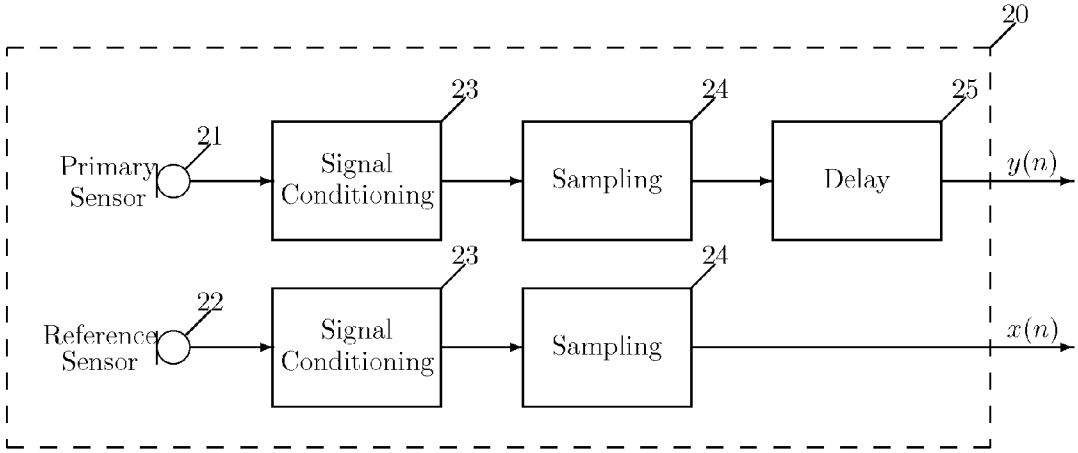
FIG. 2 is a block diagram of a signal acquisition system.

FIG. 2 shows a signal acquisition system 20 for acquiring and sampling primary and reference acoustic signals. A primary sensor 21, of which sensor 13 may be an example, senses the primary acoustic signal. A reference sensor 22 senses the reference acoustic signal. The primary and reference sensors are connected to signal conditioning blocks 23 which provide power for the sensors and amplify and bandpass filter the signals to prepare for sampling. Sampling blocks 24 sample the analog signals from the signal conditioning blocks to produce the undelayed primary digital signal and the reference digital signal x(n). For typical speech coding or recognition applications, the sampling rate ranges between 6 kHz and 16 kHz. Delay block 25 delays the undelayed primary digital signal by D samples to produce the primary digital signal y(n) where an exemplary value of D is 13. Delaying the primary signal allows future samples of the reference signal to be used when cancelling noise in the primary signal.

Figure 3:
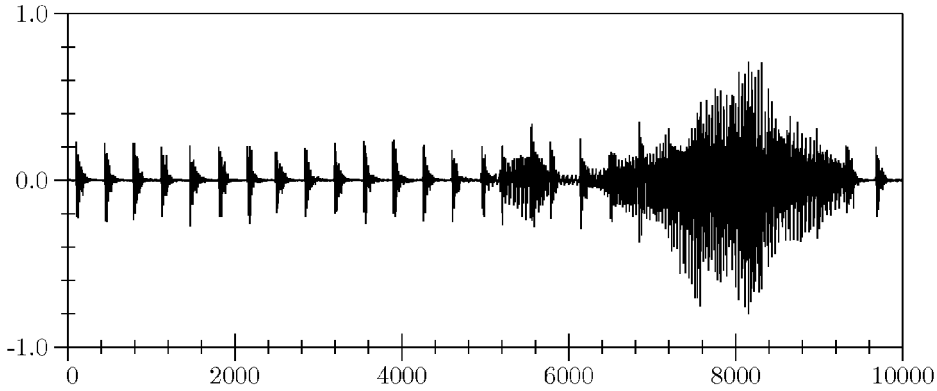
FIG. 3 shows an example of a primary signal.
Figure 4:
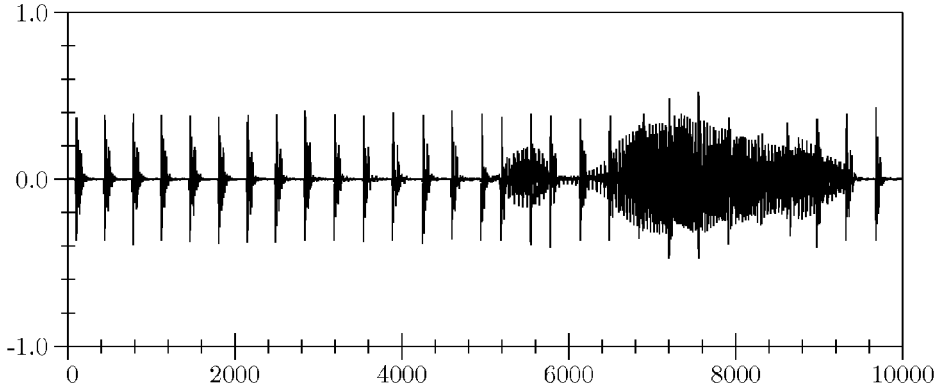
FIG. 4 shows an example of a reference signal.

FIGS. 3 and 4 show examples of primary signal y(n) and reference signal x(n) acquired using signal acquisition system 20 from primary and reference sensors mounted in breathing mask 10 as shown in FIG. 1 operating at an exemplary sampling rate of 8 kHz. From 0 to about 4800 samples, only the low air alarm signal is present. From about 5000 samples to about 9600 samples, both speech and the low air alarm are present.

Figure 5:
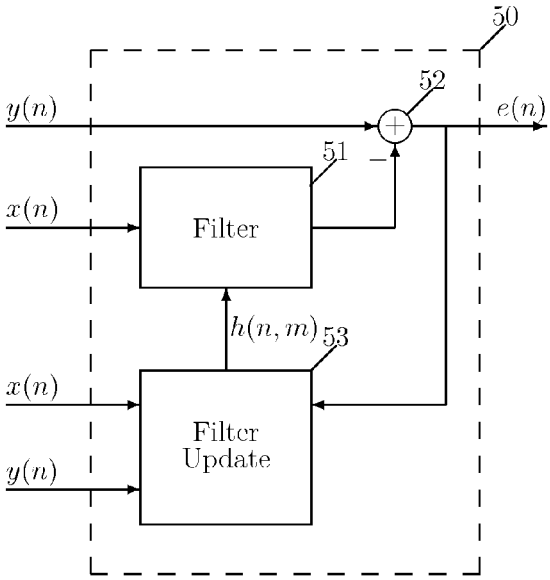
FIG. 5 is a block diagram of an adaptive noise cancellation system.

FIG. 5 shows an adaptive noise cancellation system 50 which filters reference signal x(n) using filter 51. The filter includes M filter coefficients with M having an exemplary value of 128. Each filter coefficient corresponds to a different time offset.

The filtered reference signal produced by the filter 51 is then removed from the primary signal using subtraction unit 52 to produce output signal e(n).

$$e(n) = y(n) - \sum_{m=0}^{M-1} h(n, m)x(n-m) \tag{1}$$

Filter update unit 53 updates the filter coefficients h(n, m) based on the primary signal y(n), the reference signal x(n), and the output signal e(n). A simple normalized least mean squares (NLMS) filter update is given by $$h(n+1, m) = h(n, m) + \frac{\mu}{\sigma_x^2(n)} e(n)x(n-m),\ m = 0, \ldots, M-1 \tag{2}$$

where μ is the step size with an exemplary value of $$\frac{0.2}{M} \text{ and } \sigma_x^2(n)$$

is an estimate of the variance of x(n). An estimate for $\sigma_x(n)$ is $$\sigma_x(n) = \max(\bar{\sigma}_x(n), \sigma_{min}) \tag{3}$$

where the function max(a, b) returns the maximum of a or b, $\sigma_{min}$ has an exemplary value of 0.01, and $$\bar{\sigma}_x(n) = \begin{cases} |x(n)|, & \beta|x(n)| > \sigma_x(n-1) \\ (1-\alpha)\sigma_x(n-1) + \alpha|x(n)|, & \text{otherwise} \end{cases} \tag{4}$$

where α has an exemplary value of 0.01 and β has an exemplary value of 0.0625. Estimating $\sigma_x(n)$ rather than $\sigma_x^2(n)$ reduces the dynamic range of the estimated parameter and leads to reduced computation or better performance for a fixed word length implementation.

Figure 6:
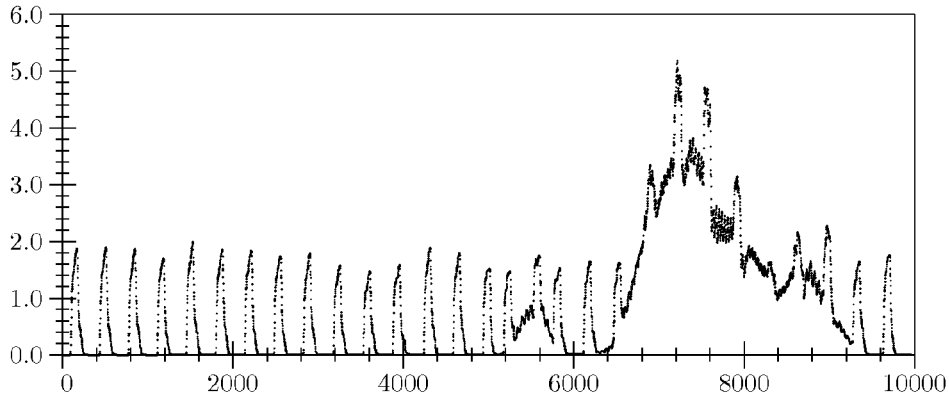
FIG. 6 shows an example of an energy signal for the reference signal of FIG. 4.

In order to prevent maladaptation of the filter when speech is present, a detector is necessary for the condition where only noise is present. A Low Air Alarm Only (LAAO) detector operates by first computing the energy in the reference signal $$\gamma(n) = \sum_{l=0}^{L-1} x^2(n-l) \tag{5}$$

where an exemplary value for the block size L is 80 samples. An example of the energy γ(n) is shown in FIG. 6 for the example reference signal shown in FIG. 4.

Figure 7:
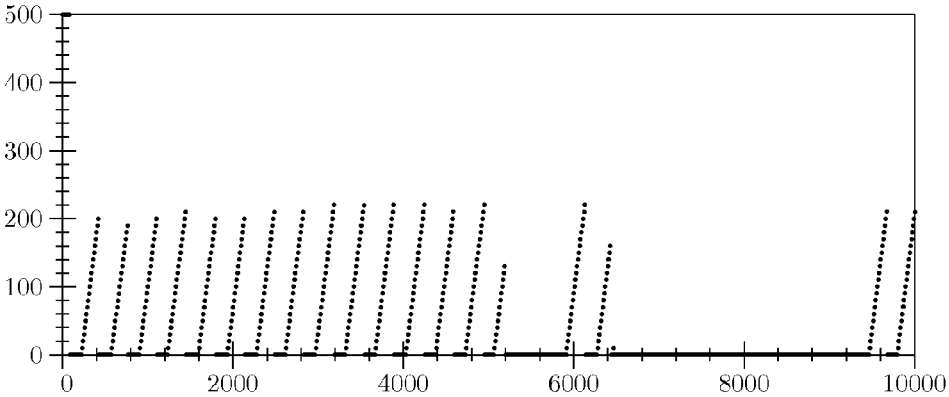
FIG. 7 shows an example of a peak count for the energy signal of FIG. 6.

The energy γ(n) is compared to a threshold $T_p$ and a peak count $N_p(n)$ of the number of consecutive samples below threshold is maintained $$N_p(n) = \begin{cases} N_p(n-S_1)+S_1, & \gamma(n) < T_p \\ 0, & \text{otherwise,} \end{cases} \tag{6}$$

where $S_1$ is the update interval with an exemplary value of 10 samples. The update interval $S_1$ may be larger than 1 without loss due to the rectangular low pass filter of length L applied to estimate the energy in Equation 5. The threshold $T_p$ has an exemplary value of 2.0. FIG. 7 shows an example of $N_p(n)$ for the energy γ(n) of FIG. 6.

The energy γ(n) is compared to a threshold $T_v$ and a valley count $N_v(n)$ of the number of consecutive samples above threshold is maintained $$N_v(n) = \begin{cases} N_v(n-S_1)+S_1, & \gamma(n) > T_v \\ 0, & \text{otherwise.} \end{cases} \tag{7}$$

Figure 8:
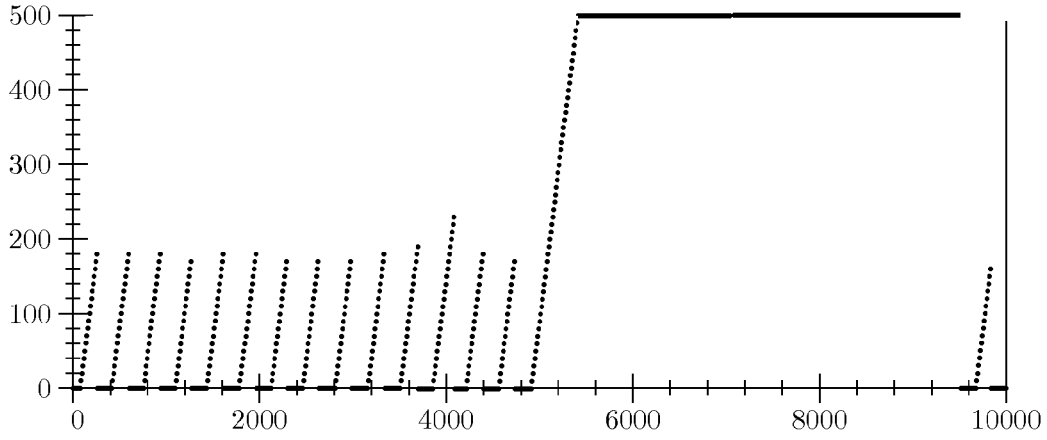
FIG. 8 shows an example of a valley count for the energy signal of FIG. 6.

The threshold $T_v$ has an exemplary value of 0.1. FIG. 8 shows an example of $N_v(n)$ for the energy γ(n) of FIG. 6. The valley count $N_v(n)$ has been limited to a maximum of 500 in FIG. 8 to reduce the dynamic range.

Figure 9:
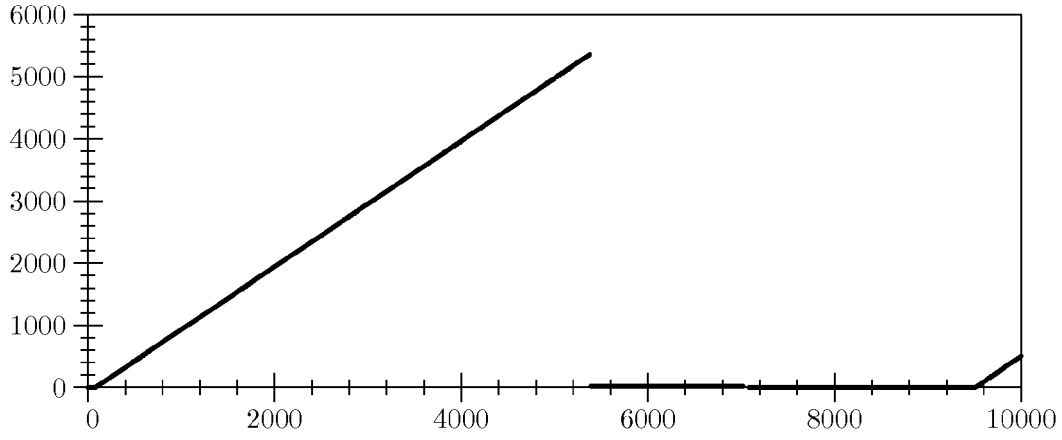
FIG. 9 shows an example of a Low Air Alarm Only count for the energy signal of FIG. 6.

The counts $N_p(n)$ and $N_v(n)$ are compared to threshold $T_n$ to update LAAO count $N_a(n)$ $$N_a(n) = \begin{cases} 0, & N_p(n) \geq T_n \\ 0, & N_v(n) \geq T_n \\ N_a(n-S_1)+S_1, & \text{otherwise} \end{cases} \tag{8}$$

where the threshold $T_n$ has an exemplary value of 500. FIG. 9 shows an example of $N_a(n)$ for the counts $N_p(n)$ and $N_v(n)$ of FIG. 7 and FIG. 8. When $N_a(n)$ exceeds a threshold $T_a$ with an exemplary value of 5000, then a LAAO detection is declared, otherwise, no detection is declared.

The convergence rate for the NLMS filter update depends on the eigenvalue spread of the covariance matrix of x(n). When x(n) is white noise, the eigenvalue spread is minimal and convergence is rapid. However, the internal reflections of the acoustic signals within the breathing mask produce resonances and antiresonances or poles and zeros in the frequency response which can produce a large spread in the eigenvalues and a consequent slow convergence rate.

One method of improving the convergence rate is to transform the signals to the frequency domain using the Discrete Fourier Transform (DFT) before updating the filter. This allows normalization by the variance estimate at each DFT frequency which effectively reduces the eigenvalue spread and increases the convergence rate. The filter update is computed by $$h(n+S,m)=h(n,m)+\mu_1 g(n,m) \tag{9}$$

where S is an update block size with an exemplary value of 80 samples, $\mu_1$ is a step size with an exemplary value of 0.1, and g(n, m) is the inverse DFT of G(n, k) computed by $$g(n,m) = \sum_{k=0}^{K-1} G(n,k)e^{\frac{j2\pi km}{K}},\ m = 0, \ldots, M-1 \tag{10}$$

where K, the DFT length, has an exemplary value of 256.

The frequency domain update G(n, k) is computed by $$G(n,k) = \frac{X(n,k)E^*(n,k)}{\sigma_x^2(n,k)} \tag{11}$$

where X(n,k) is a Short Time Fourier Transform (STFT) of x(n)

$$X(n,k) = \sum_{l=0}^{K-1} x(n-K-1+l)e^{\frac{-j2\pi kl}{K}} \tag{12}$$

and E*(n, k) is the complex conjugate of a STFT of e(n)

$$E^*(n,k) = \sum_{l=0}^{K-1} e(n-K-1+l)e^{\frac{j2\pi kl}{K}}. \tag{13}$$

The variance $\sigma_x^2(n, k)$ may be estimated as follows $$\overline{X}(n,k)=\max((|X_r(n,k)|+|X_i(n,k)|),\sigma_{min}) \tag{14}$$

$$\sigma_x(n,k) = \begin{cases} \overline{X}(n,k), & \beta\overline{X}(n,k) > \sigma_x(n-S,k) \\ \alpha\overline{X}(n,k)+(1-\alpha)\sigma_x(n-S,k), & \text{otherwise.} \end{cases} \tag{15}$$

Estimating $\sigma_x(n, k)$ rather than $\sigma_x^2(k, n)$ reduces the dynamic range of the estimated parameter and leads to reduced computation or better performance for a fixed word length implementation.

Figure 10:
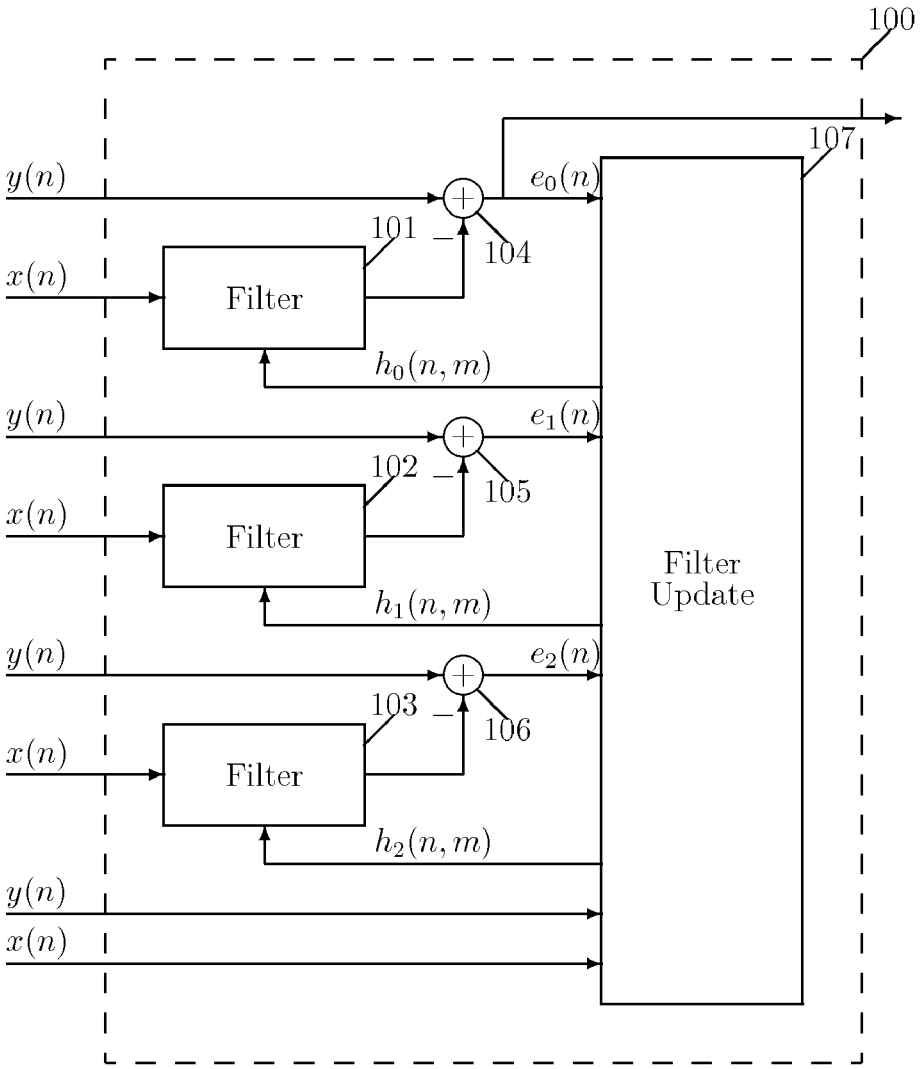
FIG. 10 is a block diagram of a triple filter adaptive noise cancellation system.

When low amplitude speech is present, such as at the start of a phrase, the LAAO detector may not properly indicate that filter adaptation should be disabled. This can lead to small maladaptations of the filter which reduces noise cancellation performance. FIG. 10 shows a method of improving performance using triple filter adaptive noise cancellation 100. The output filter 101 filters the reference signal x(n) and the resultant signal is removed from the primary signal y(n) using subtraction unit 104 to produce the output signal $e_0(n)$. The evaluation filter 102 filters the reference signal x(n) and the resultant signal is removed from the primary signal y(n) using subtraction unit 105 to produce the signal $e_1(n)$. The update filter 103 filters the reference signal x(n) and the resultant signal is removed from the primary signal y(n) using subtraction unit 106 to produce the signal $e_2(n)$. These functions are summarized in Equation 16:

$$e_p(n) = y(n) - \sum_{m=0}^{M-1} h_p(n, m)x(n-m),\ p = 0, 1, 2 \tag{16}$$

Filter update unit 107 monitors signals $e_0(n)$, $e_1(n)$, $e_2(n)$, $x(n)$, and $y(n)$ to decide how to update filters $h_0(n, k)$, $h_1(n, k)$, and $h_2(n, k)$. First, the estimated standard deviations $\sigma_{e_0}(n)$, $\sigma_{e_1}(n)$, and $\sigma_{e_2}(n)$ are updated according to Equation 17 at an interval of S samples.

$$\sigma_{e_p}(n) = (1-\alpha_1)\sigma_{e_p}(n-S) + \frac{\alpha_1}{S}\sum_{m=0}^{S-1}|e_p(n-m)|,\ p = 0, 1, 2 \tag{17}$$

Then, filter update unit 107 updates $h_2(n, m)$ in a manner similar to the single filter ANC discussed above with reference to Equation 9:

$$h_2(n+S,m)=h_2(n,m)+\mu_1 g(n,m) \tag{18}$$

Figure 11:
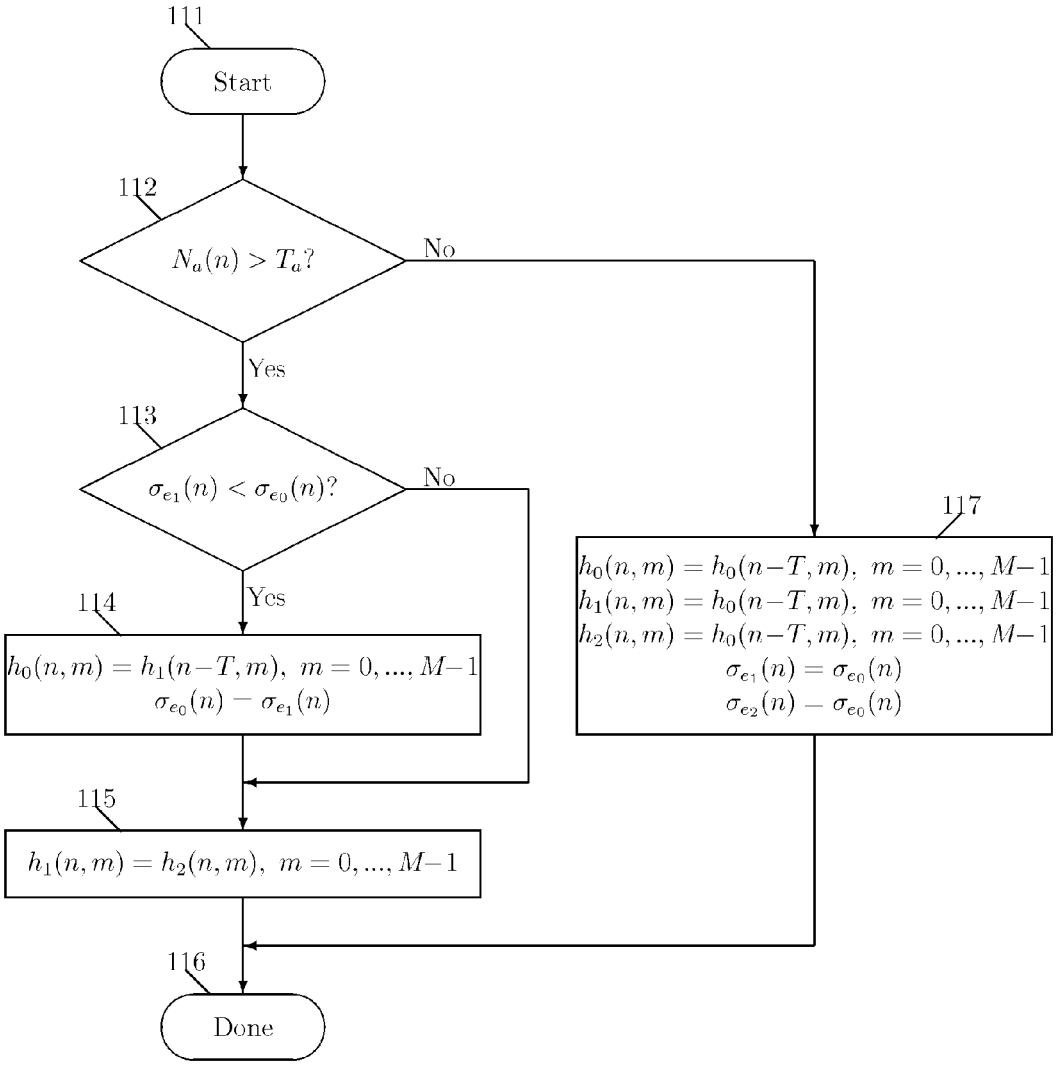
FIG. 11 is a flow chart a triple filter update system.

The other filters are updated based on the estimated standard deviations $\sigma_{e_p}(n)$,p=0, 1, 2 according to the triple filter update flow chart of FIG. 11.

The filter update unit 107 starts the triple filter update at step 111 and executes the triple filter update at an interval of T samples, where T has an exemplary value of 2000. It should be noted that if a filter update is not explicitly encountered in the flow chart, then the new value $h_p(n, m)$ should be set to the previous value $h_p(n-T, m)$. At step 112, the unit 107 compares the LAAO count $N_a(n)$ to the threshold $T_a$. If the LAAO count is greater than the threshold, the unit 107 executes step 113. Otherwise, the unit 107 proceeds to step 117.

At step 113, the unit 107 compares the estimated standard deviations $\sigma_{e_1}(n)$ and $\sigma_{e_0}(n)$. If $\sigma_{e_1}(n)$ is less than $\sigma_{e_0}(n)$, the unit 107 proceeds to step 114. Otherwise, the unit 107 proceeds to step 115.

At step 114, the unit 107 sets the coefficients of the output filter $h_0(n, m)$ to the coefficients of the previous version of the evaluation filter $h_1(n-T, m)$ since $h_1(n-T, m)$ produces a lower estimated standard deviation. At step 114, the unit 107 also sets $\sigma_{e_0}(n)=\sigma_{e_1}(n)$ since the filter coefficients were updated.

At step 115, the unit 107 sets the coefficients of the evaluation filter $h_1(n, m)$ to the coefficients of the update filter $h_2(n, m)$ so that the most recent filter update may be evaluated. Step 116 signifies the end of this update. At step 117, the unit 107 sets all of the filters to the previous value of the output filter $h_0(n-T, m)$ to prevent maladaptations in $h_1(n, m)$ and $h_2(n, m)$ from reaching the output filter $h_0(n, m)$. The unit 107 also updates the estimated standard deviations appropriately.

Figure 12:
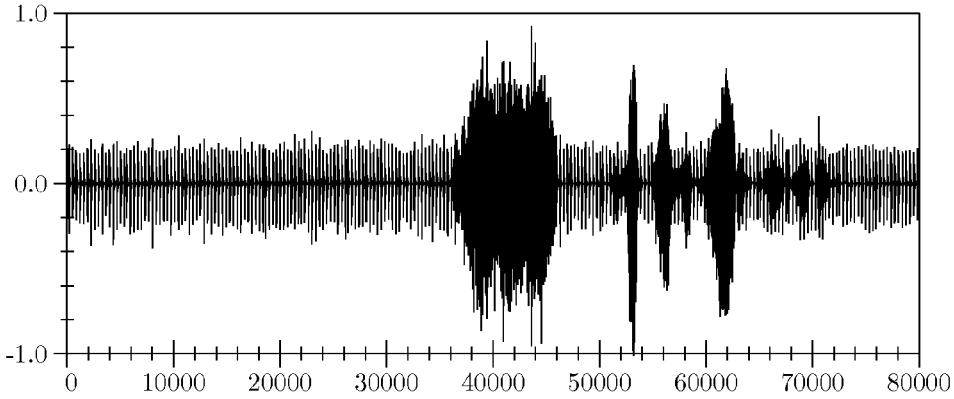
FIG. 12 shows a second example of a primary signal.
Figure 13:
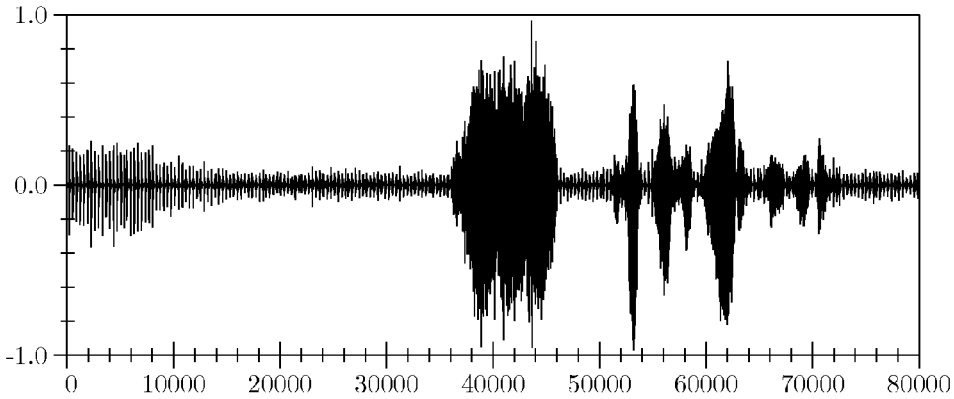
FIG. 13 shows an example of the output signal for the primary signal of FIG. 12.

FIG. 12 shows a second example of a primary signal with only a low air alarm signal before sample 35000. From sample 36000 to sample 44000, both a low air alarm and inhalation noise are present. From sample 52000 to sample 72000 both a low air alarm and speech are present. FIG. 13 shows an example of the output signal $e_0(n)$ of the triple filter adaptive noise cancellation system for the primary signal of FIG. 12. The filters adapt to reduce the level of the low air alarm signal from sample 8000 to approximately 15000 samples. After that, the reduced level of the low air alarm is maintained at about 9 dB below its level in the primary signal. There is little effect on the level of speech and inhalation noise.

Other implementations are within the scope of the following claims.

What is claimed is:

1. A breathing apparatus speech enhancement system comprising:

a breathing mask;

a primary sensor on the breathing mask and configured to produce a primary signal;

at least one reference sensor on the breathing mask and configured to produce a reference signal; and, a processor which combines at least the primary signal and the reference signal to produce an output signal with an enhanced speech component, wherein the processor is configured to:

use a filter to filter the reference signal and subtract the filtered reference signal from the primary signal to produce the output signal;

update the filter based on the output signal and the reference signal; and only update the filter when the processor detects the exclusive presence of an alarm signal by:

receiving the primary signal;

determining the energy of the primary signal; and analyzing the energy of the primary signal to determine whether the alarm signal is exclusively present.

2. The system of claim 1 wherein the primary sensor is a microphone.

3. The system of claim 2 wherein the primary sensor is a microphone of the noise cancelling or gradient type.

4. The system of claim 1 wherein at least one reference sensor is a microphone.

5. The system of claim 4 wherein at least one reference sensor is a microphone of the noise cancelling or gradient type.

6. The system of claim 1 wherein the primary sensor is mounted on the breathing mask so as to be near the mouth of a user wearing the breathing mask.

7. The system of claim 1 wherein the breathing mask includes a voice port and the primary sensor is mounted externally to the mask near the voice port.

8. The system of claim 1 wherein at least one reference sensor is mounted near a noise source.

9. The system of claim 1 wherein the breathing mask includes a breath screen to shield at least one reference sensor to reduce the impact of air flow from the user's mouth.

10. The system of claim 1 further comprising a wireless transmitter connected to transmit the primary signal wirelessly.

11. The system of claim 1 further comprising a wireless transmitter connected to transmit at least one reference signal wirelessly.

12. A communication system including the system of claim 1.

13. The system of claim 1 further comprising a speech recognition system configured to process the output signal with the enhanced speech component.

14. The system of claim 1 wherein the processor is configured to analyze the energy of the primary signal to determine whether the alarm signal is exclusively present by:

determining a peak count of the number of consecutive energy samples below a first threshold;

determining a valley count of the number of consecutive energy samples above a second threshold;

determining an alarm count of the number of consecutive samples for which the peak count and valley count are below a third threshold; and declaring the exclusive presence of the alarm signal when the alarm count exceeds a fourth threshold.

15. The system of claim 1 wherein the processor is configured to update the filter in a transform domain to improve a convergence rate of the filter.

16. A method of analyzing a digitized audio signal to detect the exclusive presence of an alarm signal, the method comprising:

receiving a digitized audio signal;

determining the energy of the digitized audio signal;

determining a peak count of the number of consecutive energy samples below a first threshold;

determining a valley count of the number of consecutive energy samples above a second threshold;

determining an alarm count of the number of consecutive samples for which the peak count and valley count are below a third threshold; and declaring the exclusive presence of the alarm signal when the alarm count exceeds a fourth threshold.

17. A system for analyzing a digitized audio signal to detect the exclusive presence of an alarm signal, the system comprising a processor configured to:

receive a digitized audio signal;

determine the energy of the digitized audio signal;

determine a peak count of the number of consecutive energy samples below a first threshold;

determine a valley count of the number of consecutive energy samples above a second threshold;

determine an alarm count of the number of consecutive samples for which the peak count and valley count are below a third threshold; and declare the exclusive presence of the alarm signal when the alarm count exceeds a fourth threshold.

* * * * *